United States Patent [19]

Frei

[11] Patent Number: 4,487,048

[45] Date of Patent: Dec. 11, 1984

[54] METHOD AND APPARATUS FOR BEADING THE BODIES OF SHEET METAL CANS

[75] Inventor: Siegfried Frei, St. Gallen, Switzerland

[73] Assignee: Cantec Inc., Forth Worth, Tex.

[21] Appl. No.: 374,147

[22] Filed: May 3, 1982

[30] Foreign Application Priority Data

May 12, 1981 [DE] Fed. Rep. of Germany ..... 3118783

[51] Int. Cl.[3] ..... B21D 15/00

[52] U.S. Cl. ..... 72/94; 72/105

[58] Field of Search ..... 72/94, 105, 106

[56] References Cited

U.S. PATENT DOCUMENTS

| | | | |
|---|---|---|---|
| 611,632 | 10/1898 | Hoffman et al. | 72/105 |
| 996,122 | 6/1911 | Osborn | 72/94 |
| 2,015,086 | 9/1935 | Paynter et al. | 29/124 |
| 2,081,042 | 5/1937 | Krueger | 72/94 |
| 2,189,004 | 2/1940 | Harwood . | |
| 3,688,538 | 9/1972 | Hoyne | 72/94 |
| 4,246,770 | 1/1981 | Franek et al. | 72/94 |

FOREIGN PATENT DOCUMENTS

| | | | |
|---|---|---|---|
| 263117 | 11/1911 | Fed. Rep. of Germany . | |
| 576312 | 5/1933 | Fed. Rep. of Germany | 72/105 |
| 1046555 | 12/1958 | Fed. Rep. of Germany . | |
| 1939623 | 2/1970 | Fed. Rep. of Germany . | |
| 2321624 | 9/1979 | Fed. Rep. of Germany . | |
| 144212 | 9/1979 | German Democratic Rep. . | |
| 1125188 | 8/1968 | United Kingdom . | |
| 1336161 | 11/1973 | United Kingdom . | |
| 1361437 | 7/1974 | United Kingdom . | |
| 1411713 | 10/1975 | United Kingdom | 72/102 |
| 1498089 | 1/1978 | United Kingdom . | |

*Primary Examiner*—Lowell A. Larson

*Attorney, Agent, or Firm*—Werner W. Kleeman

[57] ABSTRACT

A method and apparatus for beading the bodies of metal containers, wherein container bodies are rolled between an inner tool and an outer tool, for instance inner and outer rolls, in order to increase their strength. To prevent sliding of the container at the inner and outer tools the container body is coaxially retained with respect to the inner tool. The outer tool is then radially moved, during the beading operation, towards the inner tool, and then the outer tool is rolled upon the inner tool and the intermediately disposed container body.

15 Claims, 2 Drawing Figures

METHOD AND APPARATUS FOR BEADING THE BODIES OF SHEET METAL CANS

CROSS REFERENCE TO RELATED APPLICATION

This application is related to U.S. application Ser. No. 06/374,146 filed May 3, 1982 entitled "Cans Formed of Thin-Walled Material and Method of Fabricating the Same".

BACKGROUND OF THE INVENTION

The present invention relates to a new and improved method of, and apparatus for, beading the bodies of metal containers, typically sheet metal containers, especially metal cans.

In German Patent No. 2,124,038 there is disclosed a beading apparatus for the fabrication of circular beads or corrugations. By means of a roll arranged noncoaxially within the unbeaded, smooth container the container body is pressed against a curved counter rail or counter roll and rolled upon such curved counter rail or counter roll. The rolls and the rails, as the case may be, possess mutually interengaging congruent profiles which form the beads or corrugations. For exchanging the workpiece the inner roll travels axially out of the working region (container body) and frees the work station for unloading and renewed reloading.

During the machining or processing of containers with the prior art equipment the rotation of the container is accomplished by the frictional force which is present at the clamping nip between the inner roll and the outer roll. However, the force cannot be maintained constant because of the different thickness of the sheet metal material at the circumference of the container, especially when processing soldered containers having four-fold thickness of the sheet metal at the joint locations. This can produce a sliding friction which, in turn, can lead to scratches at the can lacquer or varnish. Additionally, it is impossible to fabricate other than circular beads.

Also there are known to the art apparatuses, especially for large containers, which possess both circular and non-circular cross-sectional configurations, wherein the container can be brought into the desired shape by elongation thereof through the use of radially expandable inner tools.

In the case of circular containers, especially small containers such as sheet metal cans, especially cans used in the foodstuff industry, which are fabricated in piece numbers of up to several thousand per minute by a single machine, the expanding technique no longer can be economically employed.

SUMMARY OF THE INVENTION

Therefore, with the foregoing in mind it is a primary object of the present invention to provide a new and improved method of, and apparatus for, the beading of metallic containers, especially sheet metal cans, wherein there cannot arise any sliding of the container, specifically neither upon an inner tool nor upon an outer tool, particularly in the form of inner and outer rolls.

A further significant object of the present invention relates to a new and improved method of, and apparatus for, processing containers wherein it is possible to produce the desired bead configuration or image without the use of any corresponding congruent negative form at the counter roll.

A further significant object of the present invention relates to a new and improved method of, and apparatus for, processing of containers wherein there are provided two beading rolls, neither of which needs to carry out any axial movements.

Yet a further important object of the present invention aims at minimizing the holding or retention forces at the inner tool and also the total deformation forces applied during container beading.

A further noteworthy object of the present invention relates to an improved apparatus for performing the inventive beading method, which fixedly retains the container free of any sliding or slipping movement during the entire processing work, in order to ensure for an angle-true reproducible beading configuration or image.

Now in order to implement these and still further objects of the invention, which will become more readily apparent as the description proceeds, the method for the beading of the bodies of metallic containers, especially sheet metal cans, for the purpose of increasing the strength thereof, is manifested by the features that the container body is retained coaxially with respect to the inner tool, the outer tool is advanced radially towards the inner tool during the beading operation or work, and such outer tool is then rolled upon the inner tool and the container body located between the outer and inner tools.

As alluded to above the invention is not only concerned with the aforementioned method aspects, but also relates to an improved apparatus for the beading of the bodies of metallic containers, which apparatus contains a rotating inner tool and an outer tool. The inner and outer tools are displaceable relative to one another and can roll upon one another. The axis of rotation of the inner tool is stationarily arranged.

The method of the invention and the apparatus for its performance eliminate the limitations present with the prior art machines as concerns accuracy, universality, beading forces and production capacity or output.

The slide-free and rotation-free retention of the container with respect to the rolling-off tool provides particular advantages with respect to the surface quality and the true to-size or dimensionally accurate beading work.

A further advantage resides in the fact that also beading configurations or images can be produced without any corresponding negative form at the relevant counter tool.

A still further advantage of the invention will be seen in terms of the capability of advancing and withdrawing the container without any axial displacement of the rolling tools and, consequently, without any large mass forces.

Another important advantage resides in the fact that there can be produced beading images of almost unlimited design or configuration.

A further benefit of the invention is that there can be produced beads or crimps or the like of noncoherent construction or design, for instance conical-shape, sector-shape, truncated pyramid-shape, or truncated conical-shape raised portions or depressions in a rolling-off method.

A further advantage resides in the fact that there can be produced helical and undulated beads or corrugations.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
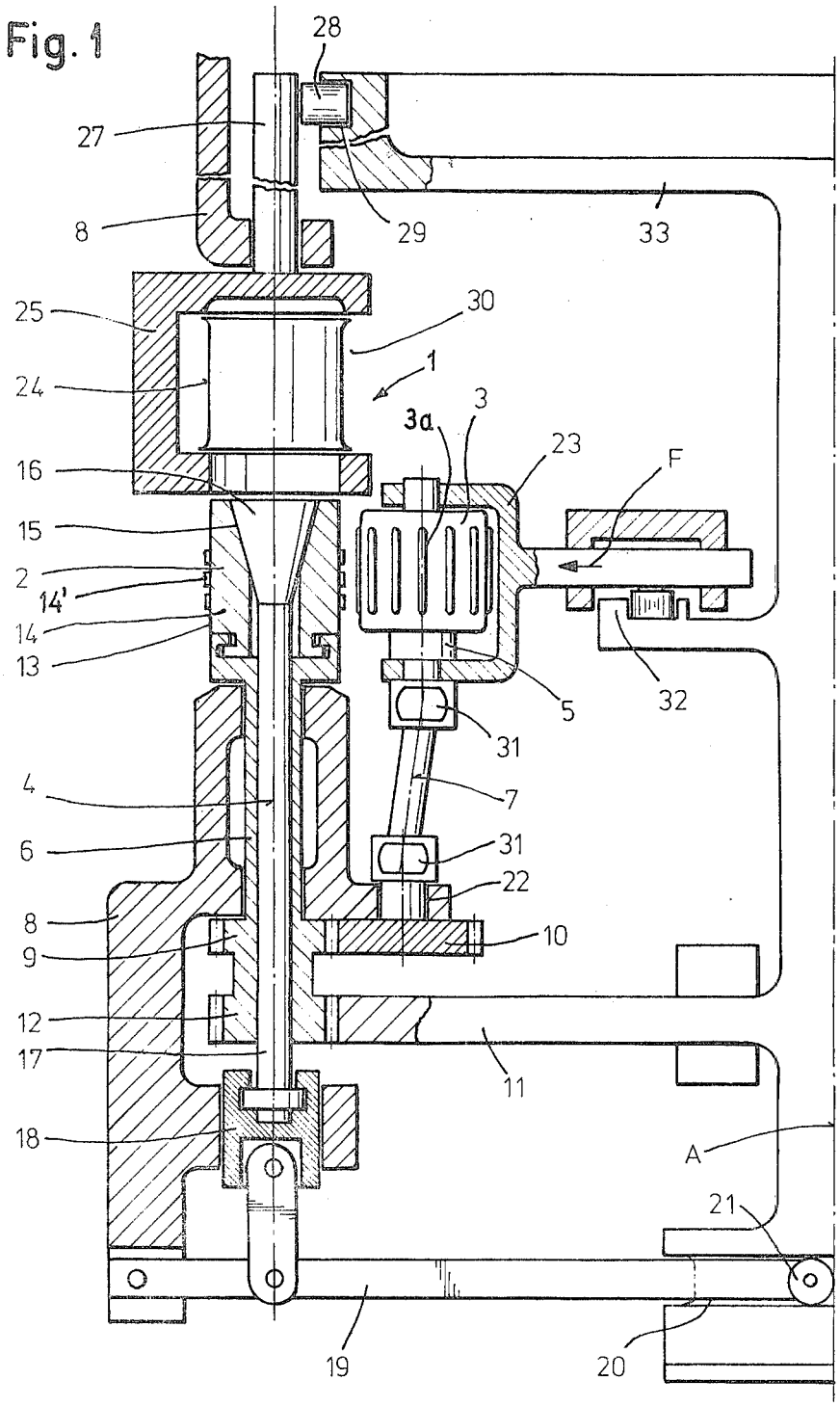
FIG. 1 is a partially fragmentary front view of an individual apparatus of a beading machine composed of a number of such beading apparatuses and shown in its loading/unloading position.

Describing now the drawings, it is to be understood that only enough of the construction of the exemplary embodiment of beading apparatus has been shown in order to enable those skilled in the art to readily understand the underlying principles and concepts of the invention, while simplifying the illustration of the drawings. Turning attention now specifically to FIGS. 1 and 2, the illustrated exemplary embodiment of beading apparatus 1 for the beading of can bodies 24 will be seen to comprise as its two more essential components an inner tool 2 in the form of a roll and an outer tool 3 in the from of a roll having at its circumference the beading protuberances 3*a* or the like. These rolls or roll members 2 and 3 possess parallel axes 4 and 5 respectively, and are driven by the related shaft members 6 and 7. As to the shaft members 6 and 7 the shaft member 6 is hollow and arranged essentially coaxially with respect to the related axis 4. Both of the shaft members 6 and 7 are rotatably mounted in a housing 8. Two meshing gears 9 and 10 which are rigidly connected for rotation with the shaft members 6 and 7, respectively, ensure for synchronous running of these shaft members 6 and 7. Driving of the gear 9, and thus, both of the shaft members 6 and 7, is accomplished by means of a further gear 12 which is rigidly connected for rotation with the shaft member 6 and by means of a drive gear 11 which meshes with the gear 12. The drive gear 11 rotates about the lengthwise axis A of the entire beading machine and is secured concentrically at a rotatable or rotary column member 33. This rotary column member or column arrangement 33 is appropriately drivable by means of any suitable drive motor, so as to perform a rotational movement about the lengthwise axis A. However, it is preferred if the rotary column 33 is stationary and the apparatus revolves along a circular path of travel about the lengthwise axis A of the rotary column 33.

At the upper end of the shaft member 6 there is mounted the roll or roller member 2 so as to be rigidly connected for rotation therewith. This roll 2 is composed of a number of expandable segments 14 which form the roll jacket or shell 13, the roll core 15, and an expanding or spreading cone 16 or equivalent structure, by means of which the can body 24 can be held fast against rotation relative to the inner roll or roll member 2 which additionally may be provided with embossing projections 14'. This expanding or spreading cone 16 is provided with a traction rod 17 located essentially coaxially with respect to the axis 4 and is axially displaceably arranged within the hollow shaft member 6. The lower end of the traction rod 17 protrudes out of the shaft member 6 and is operatively connected with a suitable displacement or lifting tool 18 which can be operated, for instance, pneumatically, hydraulically or in some other appropriate fashion.

In the embodiment as shown the traction or lift rod 17 is connected with a lever system 19 which is controlled by a cam follower 21 by means of a control cam 20. Obviously, other or equivalent control devices performing the same function as a cam and cam follower can be beneficially employed. The lift rod 17 may also be operatively connected to conventionally operated pneumatic or hydraulic actuating means as previously noted.

Either in the roll 2 or in the lifting or displacement tool 18 there are provided any suitable means of facilities which prevent the co-rotation of the traction rod 17 and/or the lifting tool 18 with the roll 2.

The shaft member 7 is constructed of a number of parts. The lower end containing the gear 10 is rotatably mounted within a sleeve 22 provided in the housing 8. The upper end of the shaft member 7 carries the roll 3 and is displaceable axially parallel within a fork or bifurcated member 23. Between the upper and lower ends of the shaft member 7 there are arranged at an axial spacing from one another two cardan intermediate elements 31, for instance cross couplings or crown gears which enable a displacement of the upper end of the shaft member 7 in the direction of the arrow F relative to the lower end of such shaft member, without hindering the rotational drive connection between the gear 10 and the roll 3.

The fork or bifurcated member 23 can be displaced for instance, with the aid of a suitable control cam arrangement 32 in such a manner that the roll 3 can lift-off from or approach, as the case may be, the coacting roll 2. Here also other structure for controlling such selective roll advancing and retraction movements different from the depicted cam arrangement 32 can be obviously employed.

According to the showing of FIG. 1, the can body 24, after it is placed into the container 25 in any conventional manner through a lateral opening 30 in the container 25, is still located externally of the roll 2 within the loading or charging container 25 arranged thereabove. This loading or charging container 25 is mounted to be axially displaceable in a guide member or guide arrangement 26 provided in the housing 8 by means of a thrust rod 27 or equivalent structure. This thrust rod 27 is coaxially arranged with respect to the axis 4. At the upper end of the thrust rod 27 there is located a follower roll 28 which can be displaced by means of a control cam 29 or equivalent structure. Once again other or equivalent control structure can be employed for appropriately operating the thrust or displacement rod 27.

Figure 2:
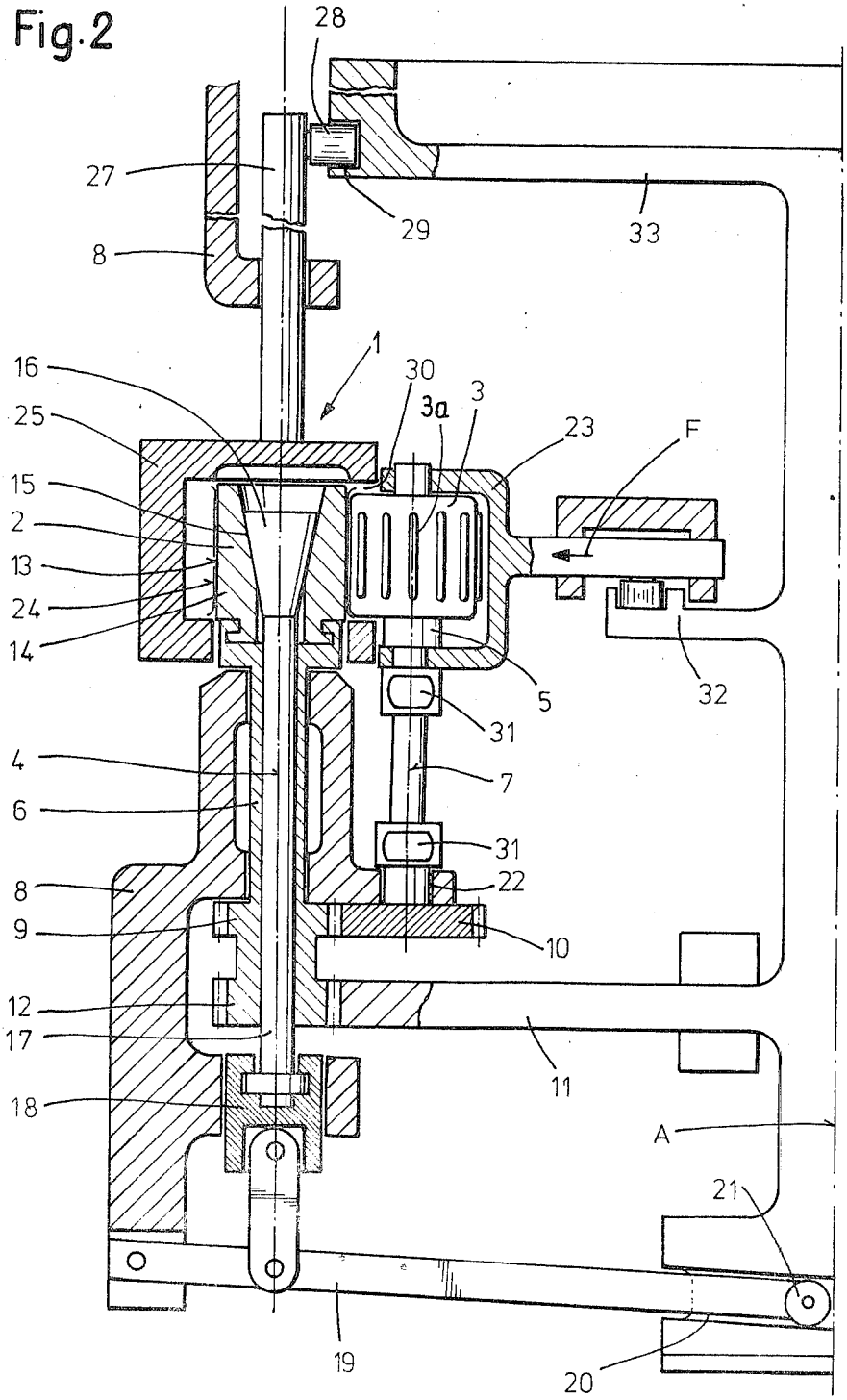
FIG. 2 is a front view of the arrangement of FIG. 1, similar to the showing thereof, but depicting the apparatus in its work position.

In FIG. 2, which illustrates the work position of the equipment, the can body 24 together with the loading or charging container 25 are located in the lower position over the roll or roll member 2. The other coacting roll or roll member 3 engages through opening 30 of the loading or charging container 25 into such container 25 and is pressed by the action of the control cam 32 against the can body 24.

The can body 24 is rigidly retained for rotation by the segment members or segments 14 which have been expanded or spread by the downwardly retracted expanding cone or cone member 16. The displacement of the cone member 16 is accomplished by the action of the control cam 20 by means of the follower roll 21 arranged at the lever 19 which actuates the lift or displacement tool 18.

The operation of the inventive method as well as the inventive beading apparatus has been divided into the following steps:

In the arrangement according to FIG. 1 a can body 24, which preferably possesses at both ends a flange or border, is inserted through the opening 30 into the loading or charging container 25 in any suitable conventional manner. Thereafter there is accomplished, by the action of the control cam arrangement 29, lowering of the loading or charging container 25 together with the can body 24 onto the roll or roll member 2. At a proper cycle time the roll 2, due to the action of the control cam arrangement 20, is spread or expanded, and thus, rigidly fixedly connects for rotation the can body 24 with the roll or roll member 2, without thereby elongating the can body 24. Thereafter, the roll 3 travels or advances towards the roll 2 by virtue of the action of the control cam arrangement 32.

As to the mode of operation of the beading equipment it is inconsequential whether or not the synchronous drive of the rolls 2 and 3 is interrupted during the loading and unloading operations.

The control cams or cam arrangements 20, 29, 32 are formed at the rotary column arrangement 33 which rotates about the lengthwise axis A of the equipment, and at which there is concentrically arranged the drive gear 11. Arranged about the lengthwise axis A are a number of, for instance 10, beading apparatuses 1 of the described type which are disposed at a uniform spacing from one another and constitute the beading machine, these beading apparatuses being acted upon by the control cams 20, 29 and 32 and the drive gear 11 of the same rotary column 33.

As already indicated, the column or column arrangement 33 can be arranged to be stationary and the beading apparatuses can be guided to revolve about the column arrangement 33 along a circular path of travel which, for instance, facilitates the work at revolving bands or belts because in such case then the can bodies 24 can be simultaneously transported from an infeed station to an outfeed or delivery station.

While there are shown and described present preferred embodiments of the invention, it is to be distinctly understood that the invention is not limited thereto, but may be otherwise variously embodied and practiced within the scope of the following claims.

What I claim is:

1. A method of beading the bodies of metal containers, especially sheet metal cans, for the purpose of increasing the strength thereof, comprising the steps of:

providing an inner tool and an outer tool between which there is beaded the container body by performing a rolling operation;

fixedly clampingly retaining for rotation the container body by means of projections on the inner tool substantially coaxially with respect to the inner tool and over a predetermined axial length of said container body;

radially advancing the outer tool towards the inner tool so as to engage the container body over said predetermined axial length thereof; and rolling the outer tool upon the inner tool and the intermediately situated container body in order to bead the container body over said predetermined axial length thereof.

2. The method as defined in claim 1, further including the steps of:

placing the container body into rotation by means of the inner tool.

3. The method as defined in claim 1 or 2, further including the steps of:

advancing the container body axially towards and away from the inner tool; and guiding a container member housing the container body for advancing and withdrawing the container body prior to and after the beading operation.

4. An apparatus for beading the bodies of metal containers, especially sheet metal cans, comprising;

a rotatable inner tool having an axial length;

a rotatable outer tool having an axial length;

means for moving relatively with respect to one another the inner and outer tools and for rolling said inner and outer tools upon one another over a predetermined part of their axial length;

said inner tool having an axis of rotation which is stationarily arranged;

said inner tool comprises a number of substantially ring-shaped arranged spreading segments;

said spreading segments in their spread position engaging the container body over a predetermined axial length thereof; and said spreading segments being provided with embossing projections for rigidly holding for rotation said container body upon the inner tool.

5. The apparatus as defined in claim 4, further including:

means provided for the inner tool for radially spreading a working surface of the inner tool for rigidly rotationally retaining the container body at and coaxially with the inner tool.

6. The apparatus as defined in claim 4, further including:

means for the actuation of said spreading segments.

7. The apparatus as defined in claim 6, wherein:

said actuation means comprises hydraulic means.

8. The apparatus as defined in claim 6, wherein:

said actuation means comprises pneumatic means.

9. The apparatus as defined in claim 4, further including:

mechanical means containing cam means for actuating said spreading segments.

10. The apparatus as defined in claim 4, further including:

a loading and positioning container member provided for carrying the container bodies; and means for guiding said loading and positioning container member lengthwise of the axis of rotation of the inner tool.

11. The apparatus as defined in claim 10, wherein:

said inner tool comprises an inner roll.

12. The apparatus as defined in claim 11, wherein:

said outer tool comprises an outer roll; and said container member possesses an opening at a nip region between both of said inner and outer rools.

13. The apparatus as defined in claim 12, wherein:

said container member is loaded and unloaded with said container bodies through said opening.

14. The apparatus as defined in claim 4, further including:

a substantially central column arrangement;

control cam means provided at said central column arrangement and arranged concentrically with respect to said central column arrangement for performing different predetermined operations;

a drive gear provided for said central column arrangement;

a multiplicity of said beading apparatuses arranged circularly about said central column arrangement;

all of said beading apparatuses coacting with the same control cams and the same drive gear; and said central column arrangement and said beading apparatuses being arranged to be rotatable relative to one another.

15. The apparatus as defined in claim 14, wherein:

said central column arrangement is arranged to be stationary; and said beading apparatuses are guidable about the central column arrangement.

* * * * *

UNITED STATES PATENT AND TRADEMARK OFFICE

CERTIFICATE OF CORRECTION

PATENT NO. : 4,487,048

DATED : December 11, 1984

INVENTOR(S) : Siegfried Frei

It is certified that error appears in the above-identified patent and that said Letters Patent is hereby corrected as shown below:

Column 6, line 60, please delete "rools" and insert --rolls--

Signed and Sealed this

*Eighteenth* Day of *June 1985*

[SEAL]

*Attest:*

DONALD J. QUIGG

*Attesting Officer*

*Acting Commissioner of Patents and Trademarks*